US009933727B2

(12) United States Patent
Reidhaar

(10) Patent No.: US 9,933,727 B2
(45) Date of Patent: Apr. 3, 2018

(54) TONER PORT SHUTTER FOR A TONER CONTAINER OF AN ELECTROPHOTOGRAPHIC IMAGE FORMING DEVICE

(71) Applicant: LEXMARK INTERNATIONAL, INC., Lexington, KY (US)

(72) Inventor: Glen Alan Reidhaar, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 15/353,042

(22) Filed: Nov. 16, 2016

(65) Prior Publication Data

US 2017/0168423 A1 Jun. 15, 2017

Related U.S. Application Data

(60) Provisional application No. 62/267,482, filed on Dec. 15, 2015.

(51) Int. Cl.
*G03G 15/08* (2006.01)

(52) U.S. Cl.
CPC ..... *G03G 15/0886* (2013.01)

(58) Field of Classification Search
CPC ..... G03G 15/0886; G03G 15/0865; G03G 15/0867; G03G 15/0839; G03G 15/0877; G03G 21/10; G03G 21/105; G03G 21/12
USPC ..... 399/358, 360, 260, 258
See application file for complete search history.

(56) References Cited

U.S. PATENT DOCUMENTS 5,006,894 A * 4/1991 Morris ..... G03G 15/0865 141/364
5,517,285 A * 5/1996 Nomura ..... G03G 15/0875 399/120

* cited by examiner

*Primary Examiner* — Susan Lee

(57) ABSTRACT

A toner container includes a housing having a reservoir for holding toner. An inlet port is formed on the housing and in fluid communication with the reservoir for receiving toner. A first shutter member and a second shutter member is positioned about the inlet port and are each pivotable between a closed position and an open position. When the first and second shutter members are in the closed positions, respective free ends thereof seal against each other and respective first face portions of the first and second shutter members seal against a perimeter of the inlet port such that the first and second shutter members block the inlet port. When the first and second shutter members are in the open positions, the first and second shutter members are pivoted away from the inlet port unblocking the inlet port. The first and second shutter members are biased toward the closed positions.

24 Claims, 12 Drawing Sheets

TONER PORT SHUTTER FOR A TONER CONTAINER OF AN ELECTROPHOTOGRAPHIC IMAGE FORMING DEVICE

CROSS REFERENCES TO RELATED APPLICATIONS

This application claims priority to U.S. Provisional Patent Application Ser. No. 62/267,482, filed Dec. 15, 2015, entitled "Toner Port Shutter for an Electrophotographic Image Forming Device," the content of which is hereby incorporated by reference in its entirety.

BACKGROUND

1. Field of the Disclosure

The present disclosure relates generally to an electrophotographic image forming device and more particularly to a toner port shutter for a toner container of an electrophotographic image forming device.

2. Description of the Related Art

Image forming devices such as printers, copiers, facsimile machines, and the like, produce unusable "waste" or residual toner as a byproduct of an electrophotographic (EP) process. Ideally, all toner that is picked up by a photoconductive (PC) drum, such as from a developer roll in a single component development system or from a magnetic roll in a dual component development system, would be transferred onto a media sheet in a one-step toner transfer process or, prior to the media sheet, onto an intermediate transfer member (ITM) in a two-step toner transfer process. However, due to inefficiencies, some of the toner picked up by the PC drum does not get transferred to the media sheet or ITM. This residual or waste toner left on the PC drum after it has contacted the media sheet or ITM must be removed before the next image is formed otherwise print defects may occur. A cleaner blade or a cleaner brush is typically placed in contact with the PC drum to wipe and remove residual toner from its surface. A similar cleaning operation may be performed to remove residual toner from the ITM where a two-step toner transfer process is used.

Waste toner is typically delivered to and stored in a removable waste toner container to prevent the waste toner from releasing inside the image forming device. It is desired to prevent toner from leaking out of the waste toner container when the waste toner container is detached from the image forming device.

SUMMARY

A toner container according to one example embodiment includes a housing having a reservoir for holding toner. An inlet port is formed on the housing and is in fluid communication with the reservoir for receiving toner. A first shutter member and a second shutter member are positioned about the inlet port and are each pivotable between a closed position and an open position. When the first and second shutter members are in the closed positions, respective free ends of the first and second shutter members seal against each other and respective first face portions of the first and second shutter members seal against a perimeter of the inlet port such that the first and second shutter members block the inlet port. When the first and second shutter members are in the open positions, the first and second shutter members are pivoted away from the inlet port unblocking the inlet port. The first and second shutter members are biased toward the closed positions.

A shutter assembly for sealing an inlet port according to another example embodiment includes a first shutter member and a second shutter member positioned about the inlet port. The first and second shutter members are each pivotable between an open position and a closed position about respective pivot axes that extend parallel to each other on opposite sides of the inlet port. When the first and second shutter members are in the closed positions, respective free ends of the first and second shutter members seal against each other and respective first face portions of the first and second shutter members seal against a perimeter of the inlet port such that the first and second shutter members block the inlet port. When the first and second shutter members are in the open positions, the first and second shutter members are pivoted away from each other and from the inlet port unblocking the inlet port. The first and second shutter members are biased toward the closed positions.

A toner container according to another example embodiment includes a housing having a reservoir for holding toner and an inlet port having an opening in fluid communication with the reservoir for receiving toner. A first shutter member and a second shutter member are positioned about the opening and are each pivotable between an open position and a closed position about respective pivot axes that extend parallel to each other on opposite sides of the opening. When the first and second shutter members are in the closed positions, respective free ends of the first and second shutter members seal against each other and respective first face portions of the first and second shutter members seal against a perimeter of the opening such that the first and second shutter members each block a respective half of the opening. When the first and second shutter members are in the open positions, the first and second shutter members are pivoted away from the opening unblocking the opening. A biasing assembly biases the first and second shutter members toward the closed positions. The biasing assembly imparts a resultant force on each of the first and second shutter members when the first and second shutter members are in the closed positions along a force vector that is angled relative to a first plane defined by the opening such that a direction of the force vector is toward the opening and a central portion of said shutter member. The force vectors of the resultant forces on the first and second shutter members when the first and second shutter members are in the closed positions both lie in a second plane that is orthogonal to the first plane and that is positioned at a midpoint of each shutter member along an axial dimension of the pivot axes such that the first and second shutter members provide a substantially uniform sealing pressure against each other and against the perimeter of the opening when the first and second shutter members are in the closed positions.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
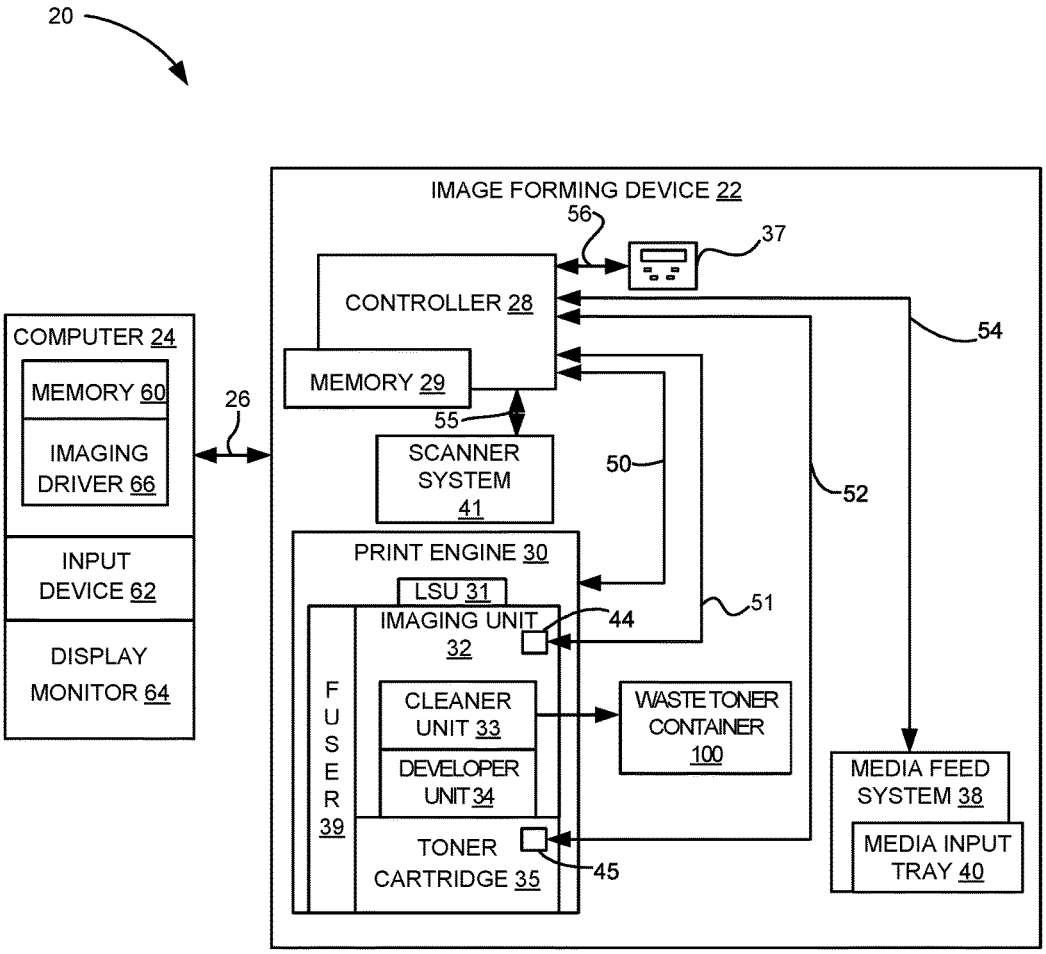
FIG. 1 is a block diagram depiction of an imaging system according to one example embodiment.

Referring now to the drawings and particularly to FIG. 1, there is shown a diagrammatic depiction of an imaging system 20 according to one example embodiment. As shown, imaging system 20 may include an image forming device 22 and a computer 24. Image forming device 22 communicates with computer 24 via a communications link 26. As used herein, the term "communications link" is used to generally refer to any structure that facilitates electronic communication between multiple components, and may operate using wired or wireless technology and may include communications over the Internet.

In the embodiment shown in FIG. 1, image forming device 22 is shown as a multifunction machine that includes a controller 28, a print engine 30, a laser scan unit (LSU) 31, an imaging unit 32, a toner cartridge 35, a waste toner container 100, a user interface 37, a media feed system 38, a media input tray 40 and a scanner system 41. Image forming device 22 may communicate with computer 24 via a standard communication protocol, such as, for example, universal serial bus (USB), Ethernet or IEEE 802.xx. A multifunction machine is also sometimes referred to in the art as an all-in-one (AIO) unit. Those skilled in the art will recognize that image forming device 22 may be, for example, an electrophotographic printer/copier including an integrated scanner system 41 or a standalone printer.

Controller 28 includes a processor unit and associated memory 29 and may be formed as one or more Application Specific Integrated Circuits (ASICs). Memory 29 may be any volatile or non-volatile memory or combinations thereof such as, for example, random access memory (RAM), read only memory (ROM), flash memory, and/or non-volatile RAM (NVRAM). Alternatively, memory 29 may be in the form of a separate electronic memory (e.g., RAM, ROM, and/or NVRAM), a hard drive, a CD or DVD drive, or any memory device convenient for use with controller 28. Controller 28 may be, for example, a combined printer and scanner controller.

In the example embodiment illustrated, controller 28 communicates with print engine 30 via a communications link 50. Controller 28 communicates with imaging unit 32 and processing circuitry 44 thereon via a communications link 51. Controller 28 communicates with toner cartridge 35 and processing circuitry 45 thereon via a communications link 52. Controller 28 communicates with media feed system 38 via a communications link 54. Controller 28 communicates with scanner system 41 via a communications link 55. User interface 37 is communicatively coupled to controller 28 via a communications link 56. Processing circuitry 44, 45 may provide authentication functions, safety and operational interlocks, operating parameters and usage information related to imaging unit 32 and toner cartridge 35, respectively. Each of processing circuitry 44, 45 includes a processor unit and associated electronic memory. As discussed above, the processor may include one or more integrated circuits in the form of a microprocessor or central processing unit and may be formed as one or more Application-specific integrated circuits (ASICs). The memory may be any volatile or non-volatile memory or combination thereof or any memory device convenient for use with processing circuitry 44, 45. Controller 28 serves to process print data and to operate print engine 30 during printing, as well as to operate scanner system 41 and process data obtained via scanner system 41.

Controller 28 oversees the functioning of the image forming device 22 including toner cartridge 35, imaging unit 32, LSU 31, user interface 37, feeding of media from removable media input tray 40, and the movement of the media along media path(s) within image forming device 22. Toner cartridge 35 and/or imaging unit 32 may also contain its own associated memory as discussed above.

Computer 24, which is optional, may be, for example, a personal computer, network server, tablet computer, smartphone or other electronic device, including memory 60, such as volatile and/or non-volatile memory, an input device 62, such as a keyboard, and a display, such as a monitor 64. Computer 24 further includes a processor, input/output (I/O) interfaces, and may include at least one mass data storage device, such as a hard drive, a CD-ROM and/or a DVD unit (not shown).

Computer 24 includes in its memory a software program including program instructions that function as an imaging driver 66, e.g., printer/scanner driver software, for image forming device 22. Imaging driver 66 is in communication with controller 28 of image forming device 22 via communications link 26. Imaging driver 66 facilitates communication between image forming device 22 and computer 24. One aspect of imaging driver 66 may be, for example, to provide formatted print data to image forming device 22, and more particularly, to print engine 30, to print an image. Another aspect of imaging driver 66 may be, for example, to facilitate collection of scanned data.

In some circumstances, it may be desirable to operate image forming device 22 in a standalone mode. In the standalone mode, image forming device 22 is capable of functioning without computer 24. Accordingly, all or a portion of imaging driver 66, or a similar driver, may be located in controller 28 of image forming device 22 so as to accommodate printing and scanning functionality when operating in the standalone mode.

Print engine 30 includes laser scan unit 31, toner cartridge 35, imaging unit 32, and a fuser 39, all mounted within image forming device 22. The imaging unit 32 is removably mounted in image forming device 22 and includes a developer unit 34 that houses a toner sump and a toner development system. In one embodiment, the toner development system utilizes what is commonly referred to as a single component development system. In this embodiment, the toner development system includes a toner adder roll that provides toner from the toner sump of developer unit 34 to a developer roll. A doctor blade provides a metered uniform layer of toner on the surface of the developer roll. In another embodiment, the toner development system utilizes what is commonly referred to as a dual component development system. In this embodiment, toner in the toner sump of developer unit 34 is mixed with magnetic carrier beads. The magnetic carrier beads may be coated with a polymeric film to provide triboelectric properties to attract toner to the carrier beads as the toner and the magnetic carrier beads are mixed in the toner sump. In this embodiment, developer unit 34 includes a magnetic roll that attracts the magnetic carrier beads having toner thereon to the magnetic roll through the use of magnetic fields. Imaging unit 32 also includes a cleaner unit 33 that houses a photoconductive drum and a waste toner removal system.

The electrophotographic process is well known in the art and will, therefore, be briefly described herein. Laser scan unit 31 creates a latent image on the photoconductive drum in the cleaner unit 33. Toner is transferred from the toner sump in developer unit 34 to the latent image on the photoconductive drum by the developer roll (in the case of a single component development system) or by the magnetic roll (in the case of a dual component development system) to create a toned image. The toned image is subsequently transferred to a media sheet from media input tray 40 for printing. Toner may be transferred directly to the media sheet by the photoconductive drum in a one-step transfer system or by an intermediate transfer member (ITM) that receives the toner from the photoconductive drum in a two-step transfer system. The toner image is bonded to the media sheet in the fuser 39 and then sent to an output location or to one or more finishing options such as a duplexer, a stapler or hole punch. Toner remnants are removed from the photoconductive drum (and, in the case of a two-step transfer system, the intermediate transfer member) by the waste toner removal system of cleaner unit 33 and are delivered to and stored in waste toner container 100 to prevent the residual toner from releasing inside the image forming device 22. In one example embodiment, waste toner container 100 is detachably attached to image forming device 22. Further, in color electrophotographic image forming devices, multiple toner cartridges, developer units, photoconductive drums and cleaner units may be required for each of the different color toners (e.g., cyan, yellow, magenta and black colored toner). A common waste toner container may be provided for storing waste toner from each of cleaner units for the different color toners. Alternatively, a separate waste toner container may be provided for each of the different color toners.

Figure 2:
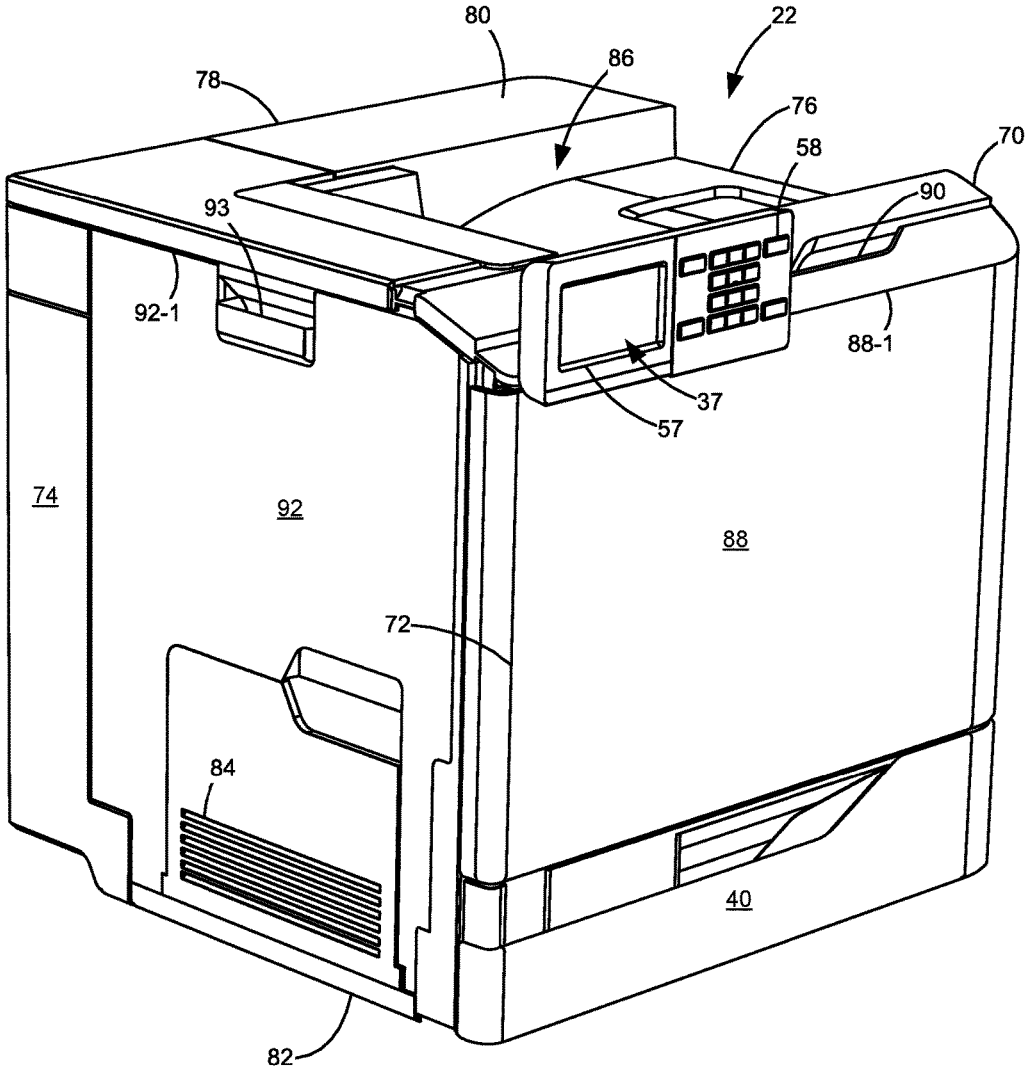
FIG. 2 is a perspective view of an image forming device according to one example embodiment.

FIG. 2 illustrates an example of image forming device 22 having a housing 70 having a front 72, first and second sides 74, 76, a rear 78, a top 80 and a bottom 82. Ventilation openings, such as vents 84 on first side 74 are provided. A media output area 86 is provided on top 80 for printed media exiting image forming device 22. A door 88 is provided on the front 72 of image forming device 22. Door release 90 is provided near a top edge 88-1 of door 88 and is used to open door 88 to allow user access into the interior of image forming device 22 for replenishing supply items such as toner cartridges. Side access door 92 is provided on first side 74 and covers portions of the media path and various feed roll pairs provided in image forming device 22. Door release 93 is provided near a top edge 92-1 of side access door 92 and is used to open side access door 92 when clearing a media jam from the media path within image forming device 22. Removable media tray 40 for providing media to be printed is slidably inserted into image forming device 22 below door 88.

User interface 37, comprising a display 57 and a key panel 58, may be located on the front 72 of housing 70. Using the user interface 37, a user is able to enter commands and generally control the operation of the image forming device 22. For example, the user may enter commands to switch modes (e.g., color mode, monochrome mode), view the number of images printed, take the image forming device 22 on/off line to perform periodic maintenance, and the like.

Figure 3:
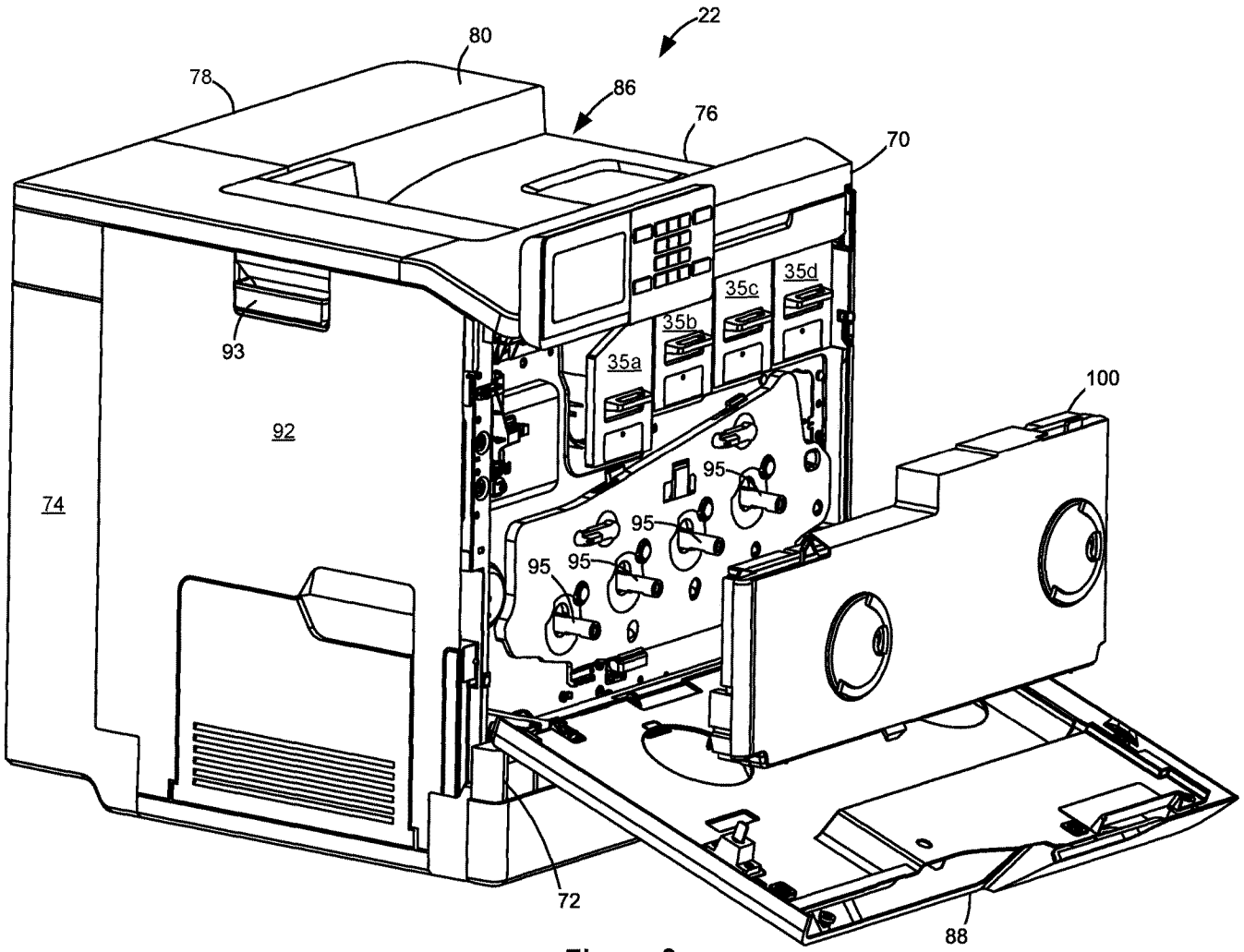
FIG. 3 is a perspective view of the image forming device shown in FIG. 2 with a front access door opened and a waste toner container detached from the image forming device.

FIG. 3 illustrates image forming device 22 with door 88 in a lowered, open position exposing interior components of image forming device 22, such as toner cartridges 35*a*, 35*b*, 35*c* and 35*d*, and with waste toner container 100 detached from image forming device 22. In the embodiment illustrated in FIG. 3, image forming device 22 is a color electrophotographic image forming device. Waste toner collected by the cleaner units in image forming device 22 for each of the different color toners are sent to waste toner container 100 through respective waste toner outlets 95. Each waste toner outlet 95 extends toward front 72 of housing 70 of image forming device 22. A similar waste toner outlet may also be provided to deliver waste toner removed from the ITM into waste toner container 100.

Figure 4:
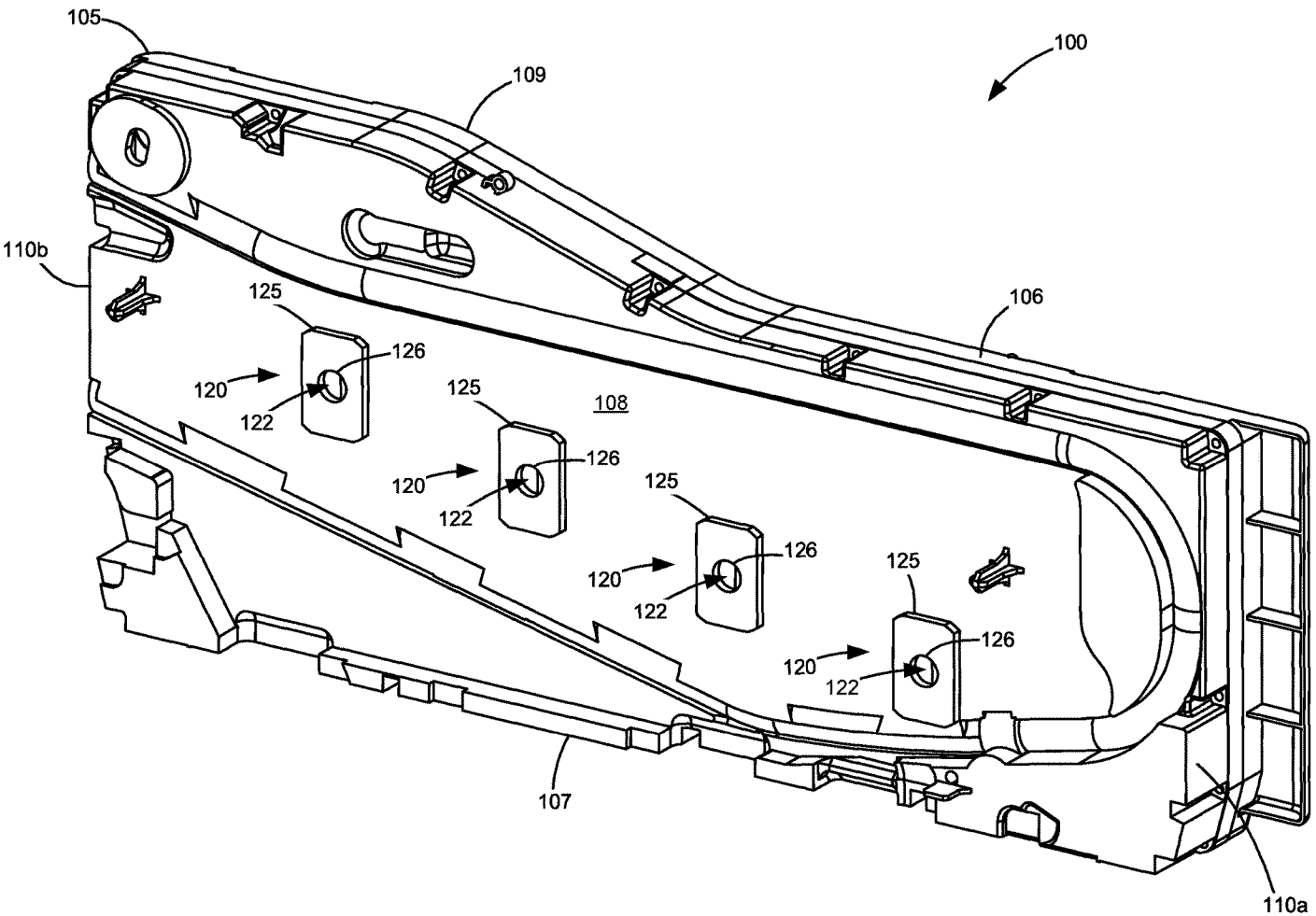
FIG. 4 is a perspective view of the waste toner container shown in FIG. 3 according to one example embodiment.

In FIG. 4, a perspective view of waste toner container 100 including a plurality of waste toner inlet ports 120 is illustrated. Waste toner outlets 95 of image forming device 22 are received by respective waste toner inlet ports 120 of waste toner container 100 when waste toner container 100 is installed in image forming device 22 to allow waste toner to be deposited into waste toner container 100. Waste toner container 100 includes a housing 105 having an enclosed waste toner reservoir for holding a quantity of waste toner therein. Housing 105 includes a top 106, a bottom 107, opposed first and second walls 108, 109, and side walls 110*a*, 110*b* forming the enclosed waste toner reservoir. Waste toner inlet ports 120 define respective through holes or openings 122 in first wall 108 of housing 105 through which respective waste toner outlets 95 of image forming device 22 are inserted into the waste toner reservoir for depositing waste toner therein. Foam seals 125 are provided on the outer side of first wall 108 about each opening 122. Each foam seal 125 has an opening 126 that is sized to sealably receive a respective waste toner outlet 95 to prevent the escape of waste toner during transport thereof through waste toner outlets 95 into the waste toner reservoir when waste toner container 100 is installed in image forming device 22.

Figure 5A:
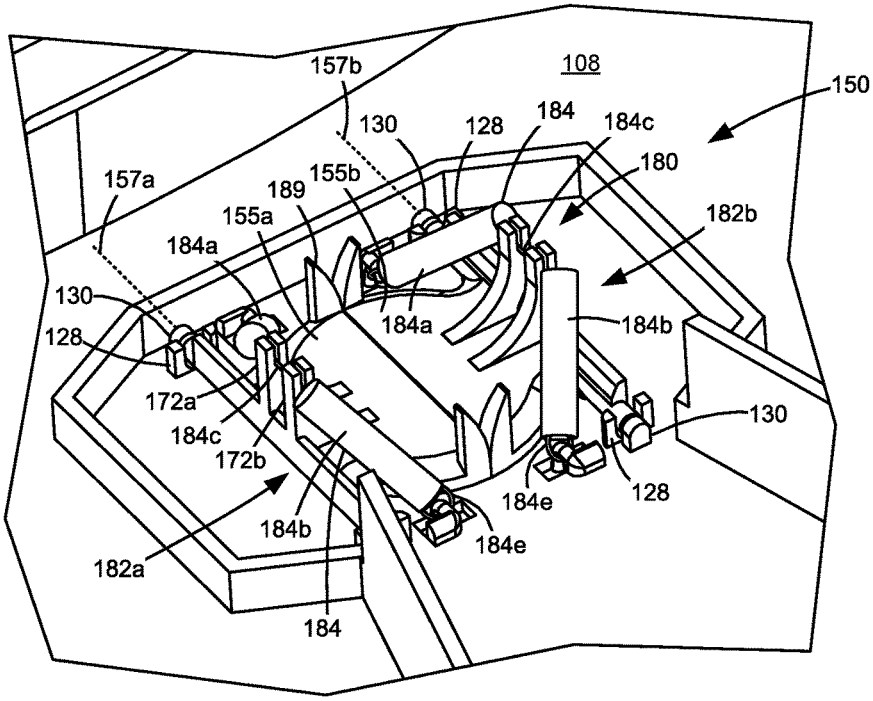
FIGS. 5A and 5B are perspective views illustrating a shutter assembly in a closed position and an open position, respectively, relative to an inlet port of the waste toner container according to one example embodiment.
Figure 5B:
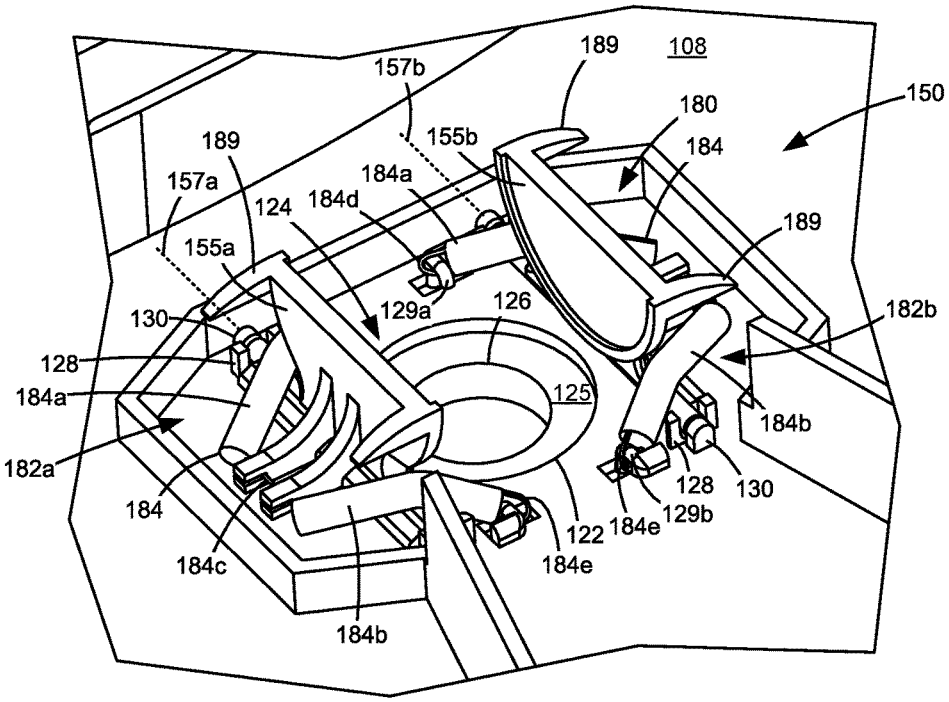
Figure 6A:
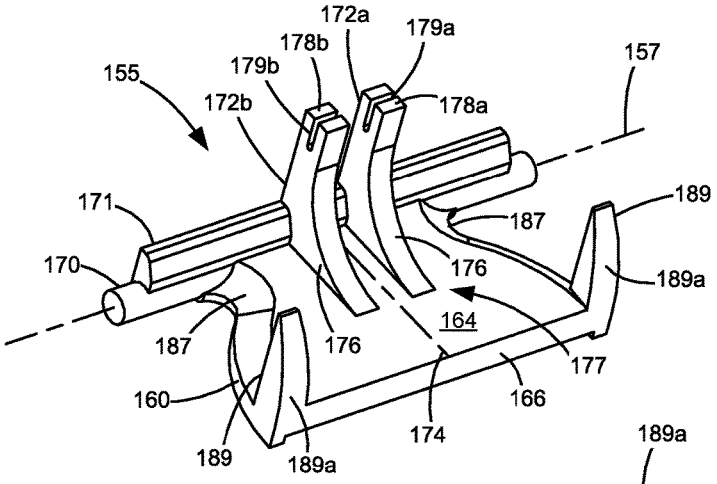
FIGS. 6A and 6B are perspective views of a shutter member of the shutter assembly shown in FIGS. 5A and 5B according to one example embodiment.
Figure 6B:
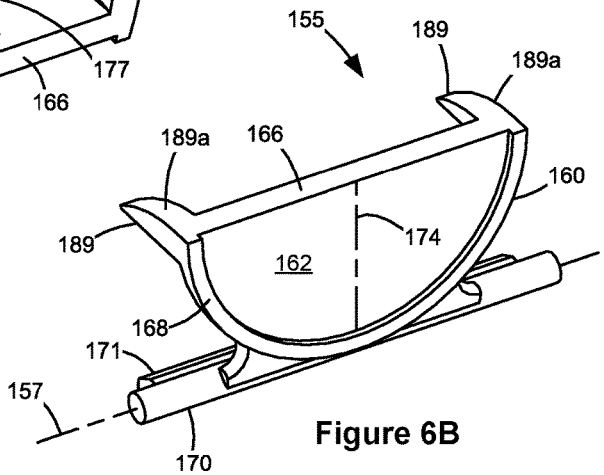
Figure 6C:
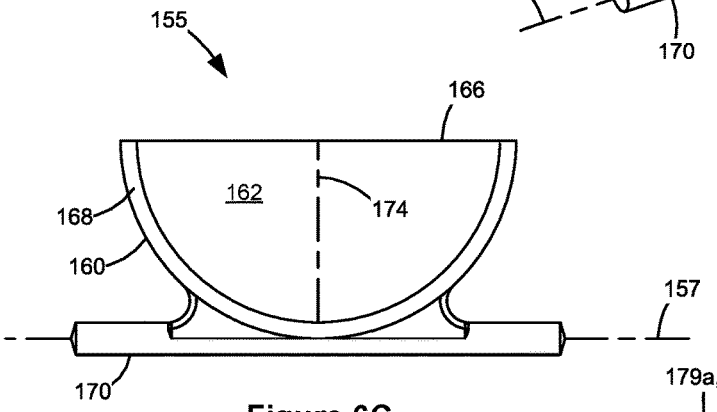
FIG. 6C is a bottom plan view of the shutter member shown in FIGS. 6A and 6B according to one example embodiment.
Figure 6D:
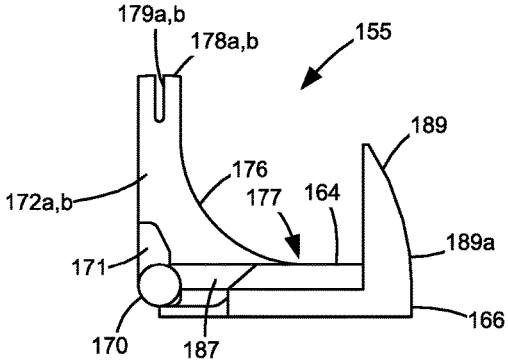
FIG. 6D is a side elevation view of the shutter member of shown in FIGS. 6A-6C according to one example embodiment.

With reference to FIGS. 5A and 5B, waste toner container 100 includes a shutter assembly 150 disposed on an inner side of first wall 108 about each opening 122 for blocking a respective inlet port 120. Shutter assembly 150 is shown as a split-shutter assembly having a pair of shutter members including a first shutter member 155*a* and a second shutter member 155*b* that each forms a half of shutter assembly 150. In one example embodiment, first and second shutter members 155*a*, 155*b* are substantially symmetrical or mirror images of each other. Hereinafter, any one of first and second shutter members 155*a*, 155*b* may be referred to as a shutter member 155. First and second shutter members 155*a*, 155*b* are disposed about opening 122 of inlet port 120 and are each pivotable between a closed position, as shown in FIG. 5A, to prevent toner leakage when waste toner container 100 is removed from image forming device 22, and an open position, as shown in FIG. 5B, when waste toner outlet 95 mates with inlet port 120 as waste toner container 100 is installed in image forming device 22. First shutter member 155*a* is pivotable about a first pivot axis 157*a* and second shutter member 155*b* is pivotable about a second pivot axis 157*b*. First and second pivot axes 157*a*, 157*b* are substantially parallel to each other on opposite sides of opening 122 of inlet port 120. In the example embodiments discussed herein, the features of the shutter assembly 150 of each inlet port 120 are substantially the same.

First and second shutter members 155*a*, 155*b* are described in further detail with reference to FIGS. 6A-6D. In one example form, each shutter member 155*a*, 155*b* has a substantially semi-circular shaped body 160 having a first face portion 162, a second face portion 164 opposite the first face portion 162, and a free end 166. First face portion 162 includes a rim 168 that forms a sealing lip. In one example, rim 168 may be integrally formed as a unitary piece with body 160. In another example, rim 168 may be made of compliant material and attached to first face portion 162. Rim 168 may be constructed of any suitable material for providing sealing, such as any suitable plastic or compliant material. When first and second shutter members 155*a*, 155*b* are in the closed positions, respective free ends 166 thereof contact and seal against each other, and respective rims 168 contact and seal against a surrounding perimeter 124 of opening 122 of inlet port 120 (see FIG. 5B) such that first and second shutter members 155*a*, 155*b* each blocks a respective half of opening 122. In the open positions, first and second shutter members 155*a*, 155*b* are pivoted away from inlet port 120 unblocking opening 122. Each of the first and second shutter members 155*a*, 155*b* includes a trunion 170 extending along an axial dimension of its respective pivot axis 157*a*, 157*b* and having opposed ends that are received within corresponding trunion retainers 128 (see FIGS. 5A and 5B) provided on the inner side of first wall 108. Low friction restraints 130 are provided at opposite ends of each trunion 170 to limit axial movement of shutter member 155. Opposite ends of each trunion 170 may have tapered tips (see FIG. 6C) to reduce frictional contact between trunion 170 and trunion restraints 130. In some embodiments, a trunion stiffener or rib 171 adds stiffness and strength to each trunion 170 and shutter member 155.

With further reference to FIGS. 5A-6D, first and second shutter members 155*a*, 155*b* are biased toward their closed positions by a biasing assembly 180. In one example embodiment, biasing assembly 180 includes a first biasing mechanism 182*a* coupled between first shutter member 155*a* and a portion of housing 105 surrounding the perimeter 124 of opening 122 of inlet port 120 and a second biasing mechanism 182*b* coupled between second shutter member 155*b* and the portion of housing 105 surrounding the perimeter 124 of opening 122 of inlet port 120. Each of the first and second shutter members 155*a*, 155*b* is shown having a pair of arms 172*a*, 172*b* extending outwardly from second face portion 164 proximate to its respective pivot axis 157*a*, 157*b* and positioned opposite each other relative to a centerline 174 of shutter member 155. In the example embodiment illustrated, each of arms 172*a*, 172*b* includes an arcuate gusset 176 that extends from a respective free end 178*a*, 178*b* of arms 172*a*, 172*b* towards second face portion 164 parallel to each other, terminating at a central portion 177 of shutter member 155. Gussets 176 add strength and rigidity to arms 172*a*, 172*b*.

In the embodiment illustrated in FIGS. 5A and 5B, first and second biasing mechanisms 182*a*, 182*b* each includes a compound tension spring 184 having a first spring coil 184*a* and a second spring coil 184*b* connected in series at an intermediate portion 184*c* therebetween. Intermediate portion 184*c* of compound tension spring 184 is inserted through spring anchors 179*a*, 179*b* formed at free ends 178*a*, 178*b* of arms 172*a*, 172*b* to attach compound tension spring 184 to arms 172*a*, 172*b*. Opposed ends 184*d*, 184*e* of compound tension spring 184 are attached to respective spring mounts 129*a*, 129*b* that are provided on the inner side of first wall 108 opposite to each other relative to arms 172*a*, 172*b* and opening 122 of inlet port 120.

Figure 7:
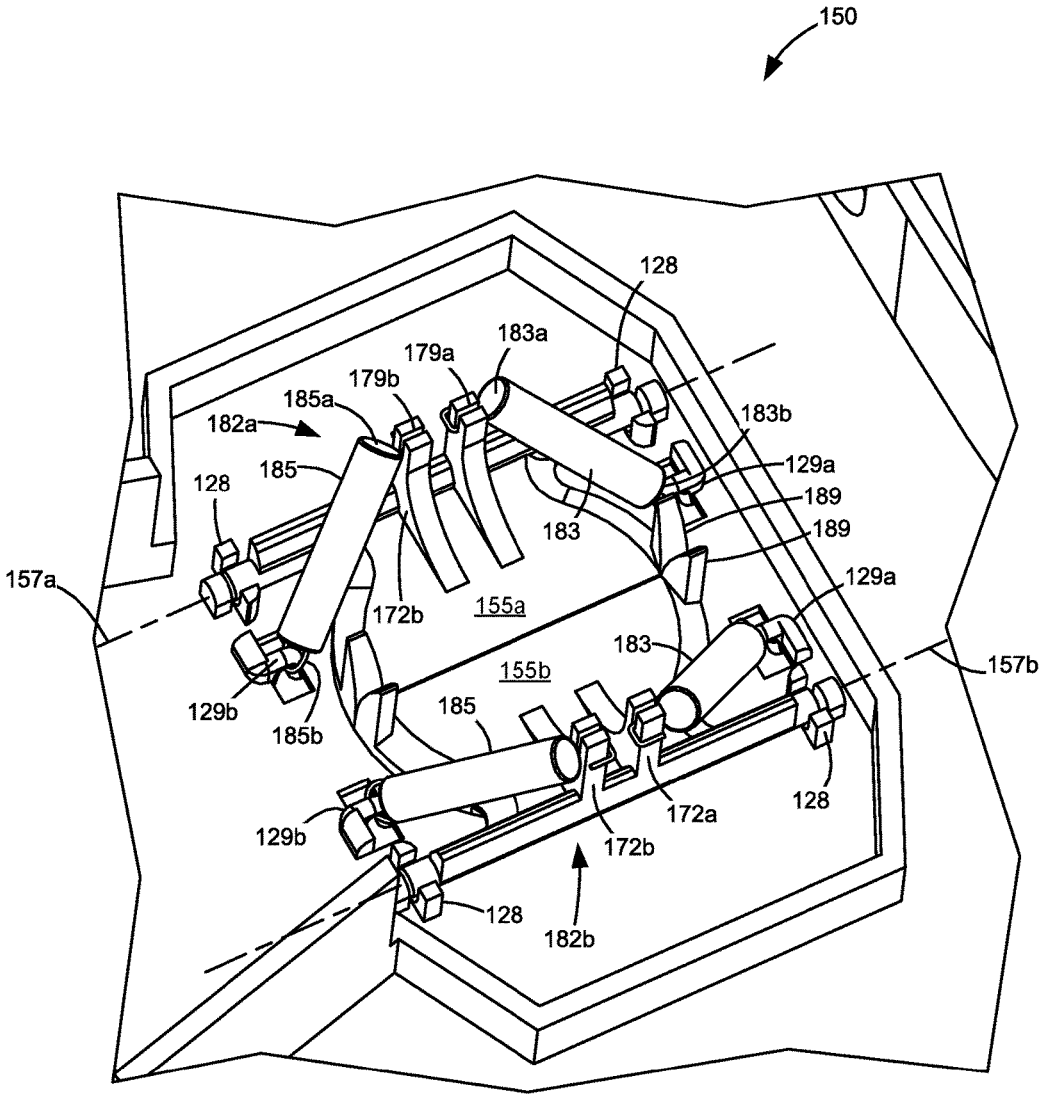
FIG. 7 is a perspective view of the shutter assembly including a biasing mechanism according to another example embodiment.

Although the example embodiment illustrated in FIGS. 5A and 5B shows each of the first and second shutter members 155*a*, 155*b* having two arms 172*a*, 172*b* coupled to first or second biasing mechanisms 182*a*, 182*b*, it will be understood that each shutter member 155 may include any number of arms for coupling with a respective biasing mechanism 182. In addition, it is understood that biasing assembly 180 may use other biasing mechanisms or any resilient member for biasing first and second shutter members 155*a*, 155*b* toward the closed positions. For example, in an alternative example embodiment illustrated in FIG. 7, each of first and second biasing mechanisms 182*a*, 182*b* includes a first tension spring 183 and a second tension spring 185. First tension spring 183 has a first end 183*a* attached to spring anchor 179*a* of arm 172*a* and a second end 183*b* attached to spring mount 129*a*. Second tension spring 185 has a first end 185*a* attached to spring anchor 179*b* of arm 172*b* and a second end 185*b* attached to spring mount 129*b* opposite spring mount 129*a* relative to arms 172*a*, 172*b*. The spring forces of first and second tension springs 183, 185 may be substantially equal and are designed to provide the biasing force needed to bias shutter member 155 towards the closed position.

In one example embodiment, each of the first and second biasing mechanisms 182*a*, 182*b* is arranged such that when first and second shutter members 155*a*, 155*b* are in the closed positions, each of the first and second biasing mechanisms 182*a*, 182*b* imparts a resultant force on a respective shutter member 155*a*, 155*b* along a force vector that is angled relative to a plane defined by the perimeter 124 of inlet port 120 such that a direction of the force vector is toward opening 122 of inlet port 120 and central portion 177 of first or second shutter member 155*a*, 155*b*. Such resultant force may be achieved by controlling the angle of first and second spring coils 184*a*, 184*b* connected between shutter member 155 and the perimeter 124 of inlet port 120.

Figure 8A:
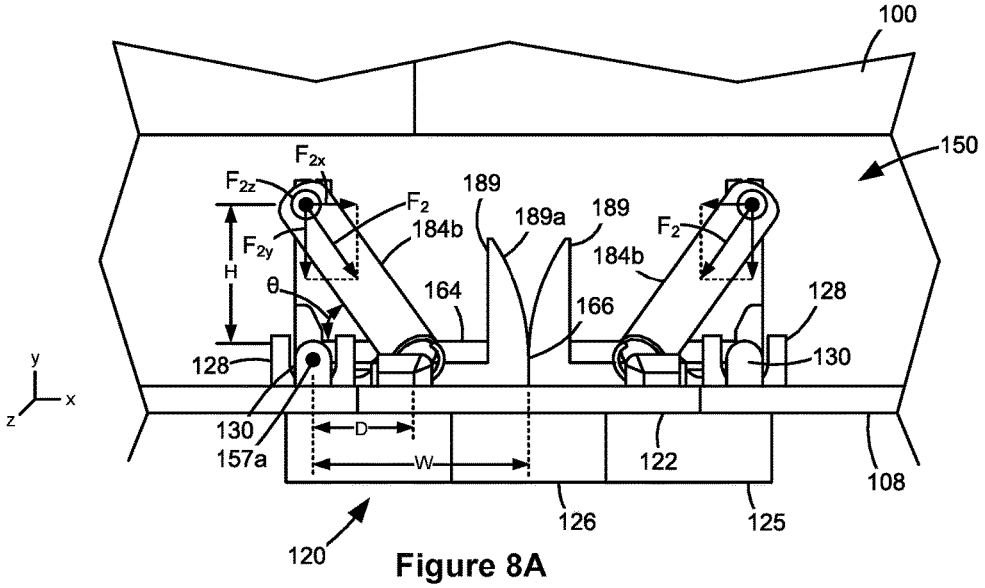
FIGS. 8A and 8B are side elevation views of the shutter assembly shown in FIGS. 5A and 5B in the closed and open positions, respectively.
Figure 9A:
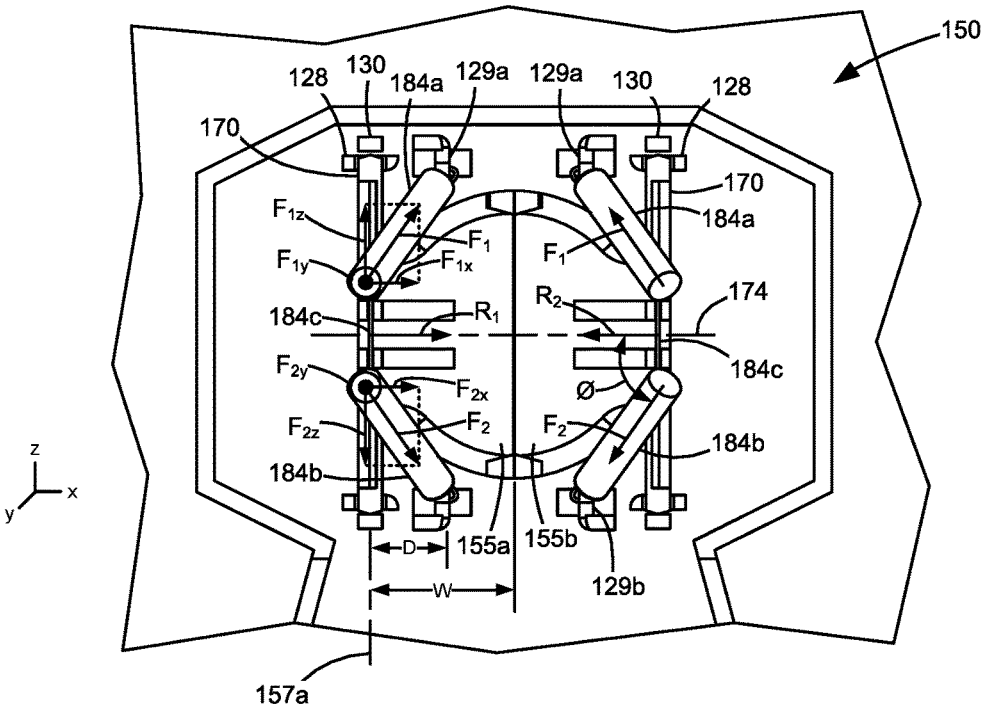
FIGS. 9A and 9B are top plan views of the shutter assembly shown in FIGS. 5A and 5B in the closed and open positions, respectively.

In general, the angle of first and second spring coils 184*a*, 184*b* are controlled by the height of spring anchors 179*a*, 179*b* of arms 172*a*, 172*b* relative to second face portion 164 and the positions of spring anchors 179*a*, 179*b* relative to spring attachment points around the perimeter 124 of inlet port 120 defined by the locations of spring mounts 129*a*, 129*b*. As an example, consider second spring coil 184*b* of first shutter member 155*a* when viewed from the side as shown in FIG. 8A. As shown, the point at which second spring coil 184*b* is attached to spring anchor 179*b* of arm 172*b* is at a height H relative to second face portion 164 and the point at which second spring coil 184*b* is attached to spring mount 129*b* is at a distance D from pivot axis 157*a* such that second spring coil 184*b* connected between spring anchor 179*b* and spring mount 129*b* is at angle θ relative to second face portion 164. Distance D may be about one-half the distance W between pivot axis 157 and free end 166. When viewed from the top as shown in FIG. 9A, second spring coil 184*b* is at an angle φ relative to centerline 174. As a result, second spring coil 184*b* imparts a spring force $F_2$ having components $F_{2x}$, $F_{2y}$, $F_{2z}$ along the x, y and z axes, respectively. First spring coil 184*a* is arranged in a similar manner to that of second spring coil 184*b* on the other side of centerline 174 (i.e., substantially symmetrical relative to second spring coil 184*b* about centerline 174) and imparts a spring force $F_1$ having components $F_{1x}$, $F_{1y}$, $F_{1z}$ along the x, y, and z axes, respectively, and having a force magnitude substantially equal to that of spring force $F_2$. It is noted that z-component $F_{2z}$ of spring force $F_2$ may be seen to be going out of the sheet on which FIG. 8A appears and z-component $F_{1z}$ of spring force $F_1$ may be seen to be going into the sheet on which FIG. 8A appears. On the other hand, y-components $F_{1y}$, $F_{2y}$ of spring forces $F_1$ and $F_2$, respectively, may be seen to be going into the sheet on which FIG. 9A appears.

Figure 10:
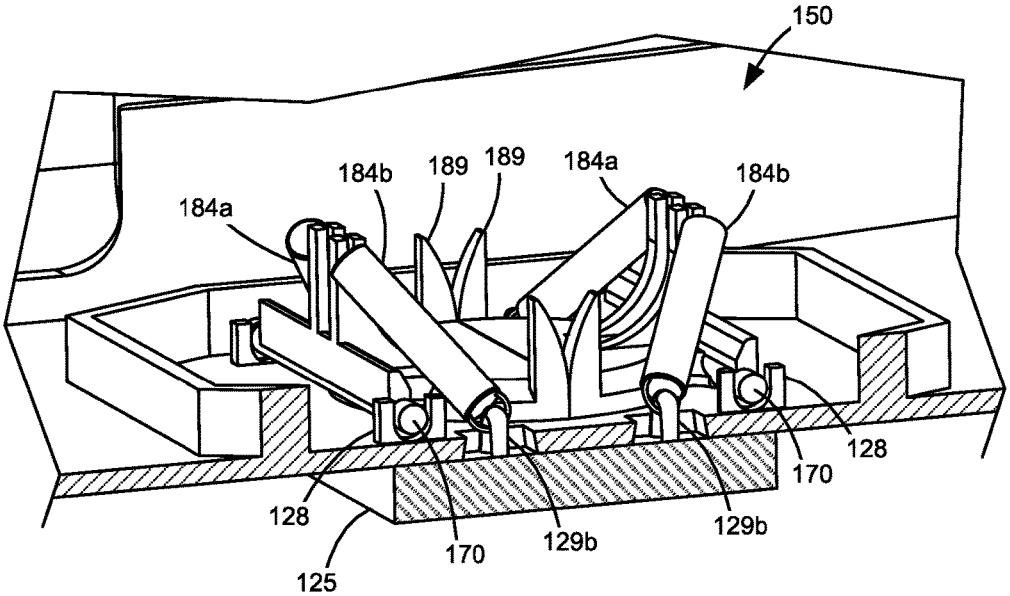
FIG. 10 is a perspective cross-sectional view of the shutter assembly shown in FIGS. 5A and 5B illustrating clearance between trunions and trunion retainers of the shutter assembly according to one example embodiment.

Having the arrangement of first biasing mechanism 182*a* shown in FIGS. 8A and 9A with first shutter member 155*a* in the closed position, a resultant force $R_1$ acts on first shutter member 155*a* which is the result of combining forces $F_1$ and $F_2$ acting on first shutter member 155*a*. The angled spring trajectories of first and second spring coils 184*a*, 184*b* introduce force components that are in directions along pivot axis 157*a*, as depicted by z-components $F_{1z}$, $F_{2z}$, but are opposite to each other thereby substantially cancelling each other out and leaving only the x and y components of forces $F_1$ and $F_2$ to contribute to the magnitude and direction of resultant force $R_1$. Any small net imbalance of force along the z direction is reacted at restraints 130 and the tips of trunion 170. The force vector of resultant force $R_1$ passes through central portion 177 of first shutter member 155*a*. In a similar manner, second biasing mechanism 182*b* of second shutter member 155*b* imparts a resultant force $R_2$ which is the result of combining forces $F_1$ and $F_2$ acting on second shutter member 155*b* due to first and second spring coils 184*a*, 184*b* connected thereto. In one embodiment, when first and second shutter members 155*a*, 155*b* are in the closed positions, the force vectors of resultant forces $R_1$ and $R_2$ both lie in the same plane that is orthogonal to the plane defined by opening 122 and/or the perimeter 124 of inlet port 120 and that is positioned along centerlines 174. By having biasing assembly 180 impart resultant forces $R_1$ and $R_2$ on first and second shutter members 155*a*, 155*b*, respectively, first and second shutter members 155*a*, 155*b* provide a substantially uniform sealing pressure against each other and against the perimeter 124 of inlet port 120 when first and second shutter members 155*a*, 155*b* are in the closed positions. In particular, the angle of first and second spring coils 184*a*, 184*b* as controlled by the locations of spring anchors 179*a*, 179*b* on first and second shutter members 155*a*, 155*b* and spring mounts 129*a*, 129*b* on the perimeter 124 of inlet port 120 cause the sealing force of free ends 166 against each other and the sealing force of rims 168 against the perimeter 124 of inlet port 120 to be substantially equal, thereby providing effective sealing against the escape of waste toner. In one embodiment, extra clearance is provided between trunion 170 and trunion retainers 128 as shown in FIG. 10 that allows for biasing assembly 180 to pull first and second shutter members 155*a*, 155*b* against each other along free ends 166 so that they seal against toner escape.

Figure 11:
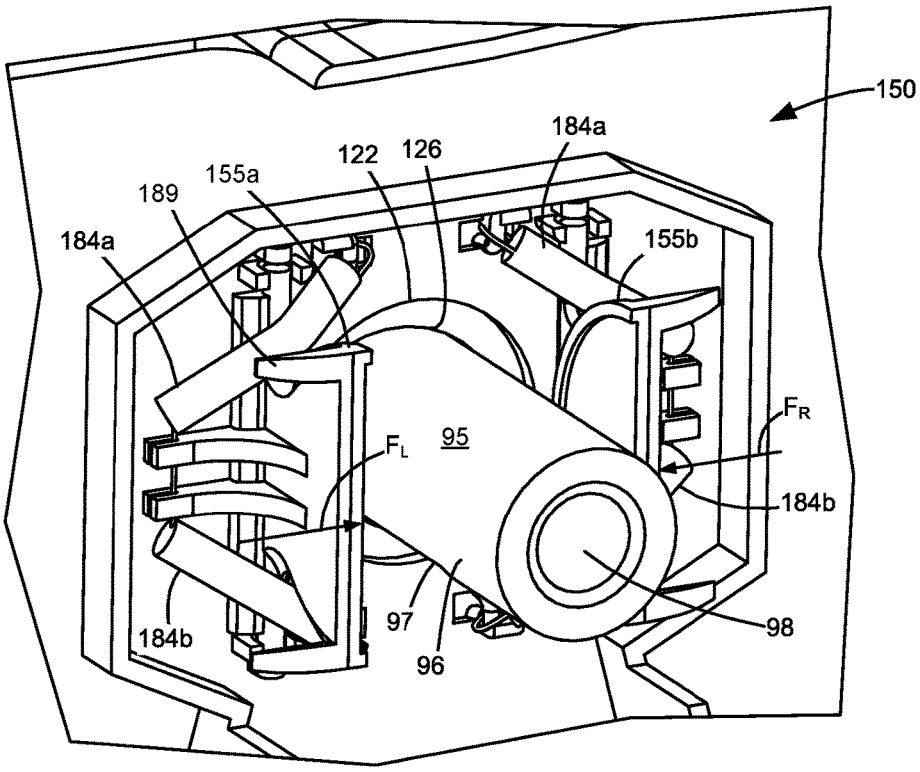
FIG. 11 is a perspective view of the shutter assembly shown in FIGS. 5A and 5B in the open position with a waste toner outlet inserted into the inlet port of the waste toner container according to one example embodiment.

When waste toner container 100 is installed in image forming device 22, waste toner outlet 95 is inserted through opening 122 of inlet port 120 and into the waste toner reservoir, as shown in FIG. 11, engaging and moving first and second shutter members 155*a*, 155*b* from the closed positions to the open positions. The length of, and volume of space occupied by, each of first and second spring coils 184*a*, 184*b* is minimized by angling them from spring mounts 129*a*, 129*b* inwardly towards centerline 174, overlapping with shutter member 155 as can be seen in FIG. 9A. In order to allow shutter member 155 to move between the closed and open positions without interference from first and second spring coils 184*a*, 184*b*, each of first and second shutter members 155*a*, 155*b* are provided with crescent-shaped notches 187 formed along peripheral edges of second face portion 164 (see FIG. 6A). In general, notches 187 are sized and shaped such that first and second spring coils 184*a*, 184*b* travel within respective notches 187 of shutter member 155 as shutter member 155 moves between the closed and open positions. For example, notches 187 may conform to the shape of first and second spring coils 184*a*, 184*b* and to the path of motion followed by first and second spring coils 184*a*, 184*b* as shutter member 155 moves between the closed and open positions. As a result, shutter member 155 and first and second coils 184*a*, 184*b* connected thereto are free to move without interfering with each other.

Figure 8B:
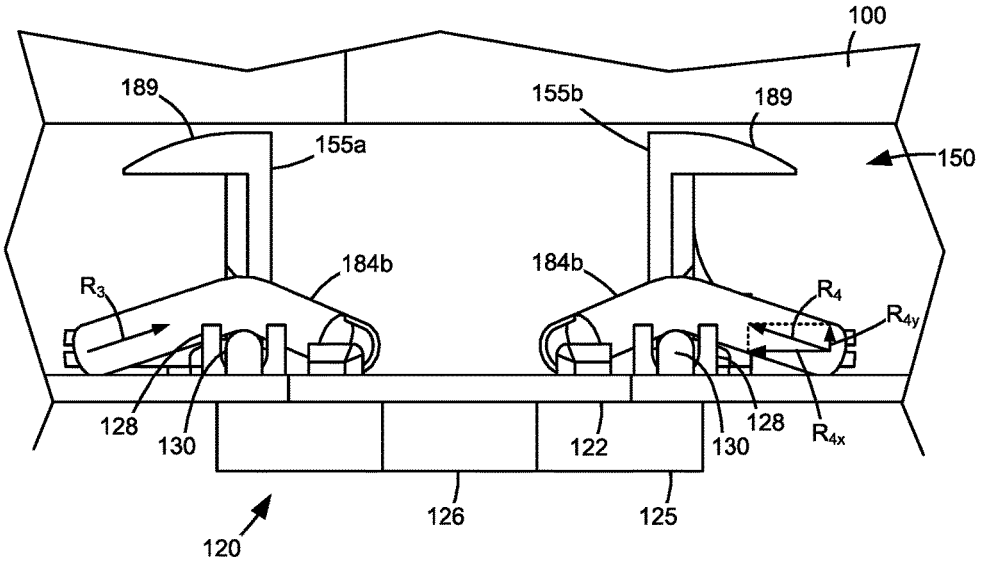
Figure 9B:
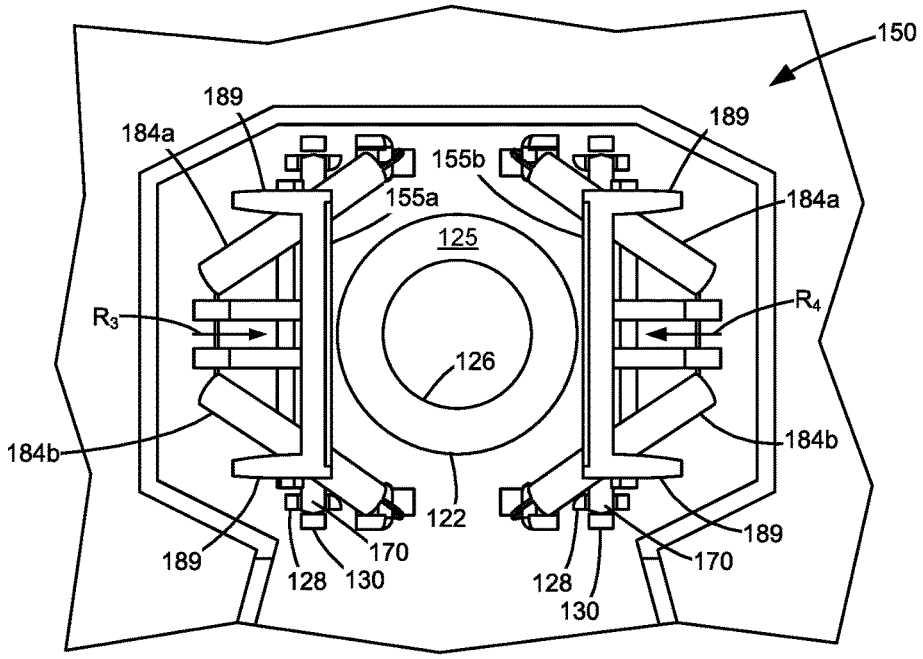
Figure 12A:
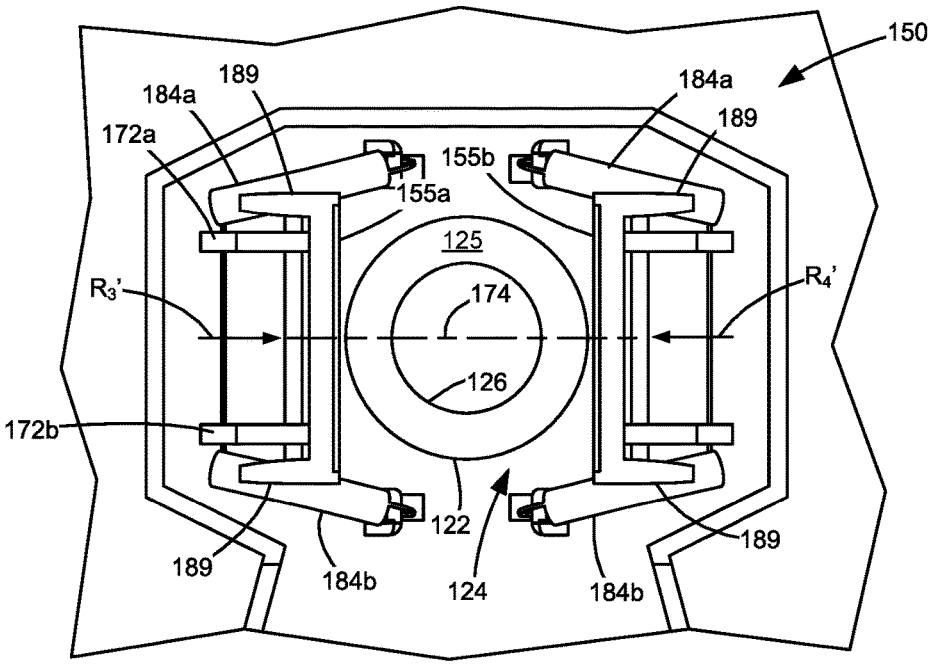
FIGS. 12A and 12B are a top plan and a side elevation view, respectively, of the shutter assembly including a biasing mechanism according to another example embodiment.
Figure 12B:
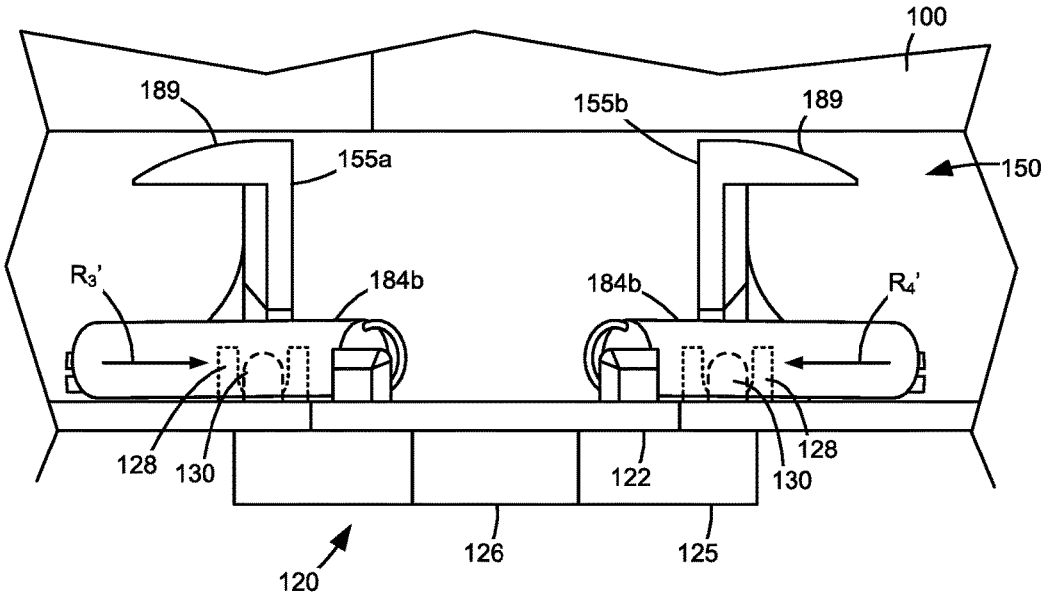

In the example embodiment illustrated, when each of the first and second shutter members 155*a*, 155*b* is in the open position, first and second spring coils 184*a*, 184*b* lay across trunion 170 (see also FIGS. 8B and 9B). Although first and second spring coils 184*a*, 184*b* are stretched when first and second shutter members 155*a*, 155*b* are in the open positions, tension is adjusted by allowing first and second spring coils 184*a*, 184*b* to bend as central portions thereof are seated over trunion 170 such that a large increase of force acting on shutter member 155 (relative to the sealing force in the closed position) that biases the shutter member 155 towards the closed position is prevented. FIG. 9B shows first and second spring coils 184*a*, 184*b* of first biasing mechanism 182*a* imparting a resultant force $R_3$ on first shutter member 155*a* and first and second spring coils 184*a*, 184*b* of second biasing mechanism 182*b* imparting a resultant force $R_4$ on second shutter member 155*b*. Resultant forces $R_3$ and $R_4$ are generally coplanar with resultant forces $R_1$ and $R_2$. Considering, for example, resultant force $R_4$ shown in FIG. 8B, a relatively large vector component $R_{4x}$ of resultant force $R_4$ is the horizontal component (as viewed in FIG. 8B) which acts to push trunion 170 against its trunion retainer 128, while a relatively small vector component $R_{4y}$ of resultant force $R_4$ is the vertical component (as viewed in FIG. 8B) which acts to rotate and bias shutter member 155 toward the closed position. In other example embodiments, each resultant force $R_3$ and $R_4$ may have an almost zero vector component acting to bias shutter member 155 towards the closed position. For example, in another example embodiment, illustrated in FIGS. 12A and 12B, trunions 170 are shortened so that trunion retainers 128 and restraints 130 are located closer to the peripheral edges of shutter member 155 and arms 172*a*, 172*b* are moved outward farther away from centerline 174 such that compound tension spring 184 can lay flat against the portion of housing 105 surrounding perimeter 124 outside tunion retainers 128 when shutter member 155 is fully opened. In this embodiment, when shutter member 155 is fully opened, each resultant force $R_3'$ and $R_4'$ has nearly its full value acting to push trunion 170 against its trunion retainer 128 and nearly zero vector component acting to bias shutter member 155 towards the closed position. In these example embodiments, the magnitude of each of resultant forces $R_3$ and $R_4$ acting on first and second shutter members 155*a*, 155*b* when in the open positions may be slightly greater than, equal to, or even substantially less than the magnitude of the resultant forces $R_1$ or $R_2$ acting on the shutter member 155 in the closed position.

First and second shutter members 155*a*, 155*b* push against waste toner outlet 95 substantially equally from opposite sides of waste toner outlet 95, as depicted by forces $F_L$ and $F_R$ in FIG. 11, such that there is no side-loading on waste toner outlet 95 and consequently an approximately zero net side-force exerted by shutter assembly 150 on waste toner outlet 95 thereby reducing the likelihood of bending or deforming waste toner outlet 95 over time. The approximately zero net side-force exerted by shutter assembly 150 on waste toner outlet 95 also reduces the likelihood of biasing imaging unit 32 sideways, which could misalign imaging unit 32 relative to the printed media (or the ITM where a two-step toner transfer process is used) and affect print registration and quality. When waste toner outlet 95 is fully inserted into inlet port 120 and shutter assembly 150 is fully opened, first and second shutter members 155*a*, 155*b* are positioned substantially parallel to the direction of insertion of waste toner outlet 95 into inlet port 150 such that first and second shutter members 155*a*, 155*b* apply approximately zero force on waste toner outlet 95 along the direction of insertion. As a result, shutter assembly 150 does not apply a residual force in a direction that would push waste toner outlet 95 out of inlet port 120.

When waste toner container 100 is detached from image forming device 22, waste toner outlet 95 is dislodged out of inlet port 120 and first and second shutter members 155*a*, 155*b* return to their closed positions due to the biasing forces of biasing assembly 180. Typically, first and second shutter members 155*a*, 155*b* close simultaneously when waste toner container 100 is removed from image forming device 22 as the removal of waste toner outlet 95 from inlet port 120 releases the first and second shutter members 155*a*, 155*b* simultaneously. In order to account for the possibility of first and second shutter members 155*a*, 155*b* closing at different times, a safety mechanism is provided to prevent one shutter member from blocking closure of the other shutter member. In one example embodiment, each of first and second shutter members 155*a*, 155*b* includes one or more guides 189 projecting from second face portion 164 thereof for facilitating movement of first and second shutter members 155*a*, 155*b* toward the closed positions. In the example shown, each guide 189 has an arcuate contact surface 189*a* extending from free end 166, with the arcuate contact surfaces 189*a* of guides 189 of first shutter member 155*a* arranged to slide against corresponding arcuate contact surfaces 189*a* of guides 189 of second shutter member 155*b* during instances where first and second shutter members 155*a*, 155*b* move toward the closed positions at different times. More particularly, when one of the first and second shutter members 155*a*, 155*b* lags behind the other in reaching the closed position, guides 189 of the lagging shutter member 155 slide against corresponding guides 189 of the first-to-close shutter member 155 until the lagging shutter member 155 reaches its closed position. Accordingly, the shutter member 155 that first reaches the closed position is prevented from blocking the lagging shutter member 155 from reaching its closed position. In one example, guides 189 may be made of material that provides sufficiently low coefficient of friction such that the biasing force of biasing assembly 180 may allow one shutter member 155 to slide against the other shutter member 155 via guides 189 and reach the closed position. In addition, the amount of clearance between trunion 170 and trunion retainers 128 may be selected such that guides 189 do not contact each other too early as biasing assembly 180 pulls the first and second shutter members 155*a*, 155*b* toward each other before the closed position is reached.

Figure 13A:
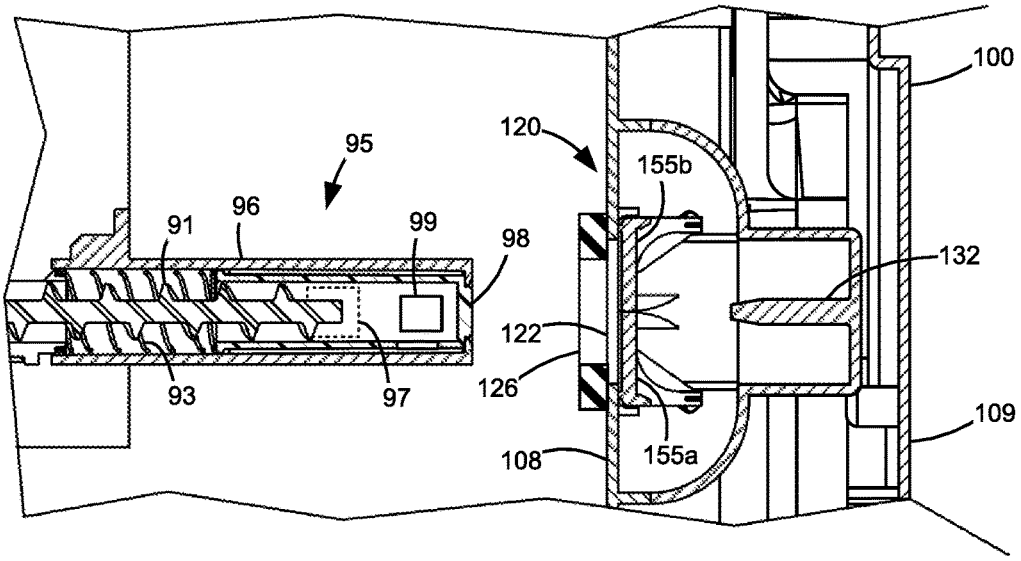
FIGS. 13A and 13B are top cross-sectional views illustrating an actuator of the waste toner container that opens a shutter of the waste toner outlet as the waste toner container is installed in the image forming device according to one example embodiment.
Figure 13B:
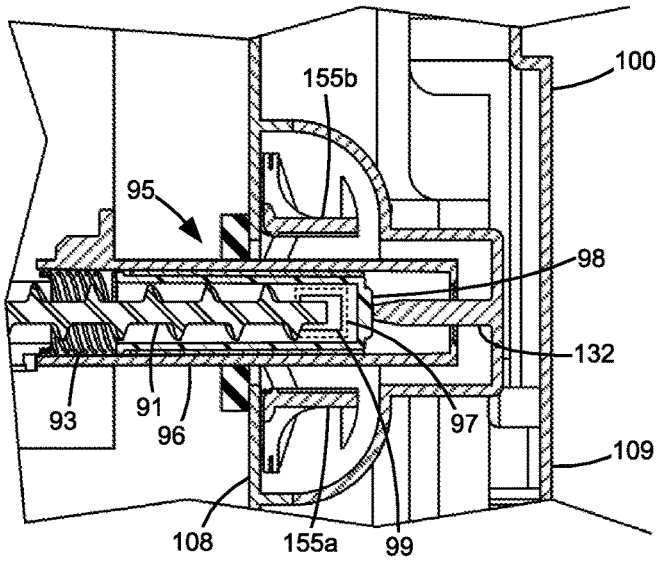

With each of the first and second shutter members 155*a*, 155*b* forming a half of shutter assembly 150, first and second shutter members 155*a*, 155*b* swing through a small volume of space within the waste toner reservoir relative to the space that would be occupied by a conventional single swinging shutter member sealing opening 122 thereby permitting the use of an actuation finger in waste toner container 100 for actuating waste toner outlet 95. FIG. 13A illustrates an example top cross-sectional view of waste toner outlet 95 when waste toner container 100 is detached from image forming device 22 and FIG. 13B illustrates waste toner outlet 95 inserted into inlet port 120 of waste toner container 100 when waste toner container 100 is installed in image forming device 22. In the example shown, waste toner outlet 95 includes a toner discharge pipe 96 having a hole 97 provided in a lower portion thereof through which waste toner exits waste toner outlet 95, and a shutter 98 disposed within toner discharge pipe 96 and having an opening 99 provided in a lower portion thereof. A drive mechanism (not shown) drives and rotates an auger mechanism 91 within waste toner outlet 95 to move waste toner collected by each cleaner unit 33 towards the free end of waste toner outlet 95. Shutter 98 is slidably movable within toner discharge pipe 96 between a closed position and an open position. In the closed position, shutter 98 blocks hole 97 of toner discharge pipe 96 to prevent toner from escaping waste toner outlet 95 when waste toner container 100 is removed from image forming device 22 as shown in FIG. 13A. Shutter 98 is biased toward the closed position blocking waste toner outlet 95 such as, for example, by one or more compression springs 93. In the open position shown in FIG. 13B, opening 99 of shutter 98 aligns with hole 97 of toner discharge pipe 96 to permit waste toner to exit waste toner outlet 95 through opening 99 and hole 97, and be deposited into the waste toner reservoir of waste toner container 100, A protrusion 132 protrudes within the waste toner reservoir in a direction toward opening 122 of inlet port 120. As waste toner outlet 95 is inserted into inlet port 120 of waste toner container 100, protrusion 132 provided in waste toner container 100 presses shutter 98 of waste toner outlet 95, causing shutter 98 to slide from the closed position to the open position. When shutter 98 of waste toner outlet 95 reaches the open position, opening 99 of shutter 98 aligns with hole 97 of toner discharge pipe 96 to permit waste toner to transfer from cleaner unit 33 of image forming device 22 to waste toner container 100. Protrusion 132 protrudes at a length that is clear from engagement with first and shutter members 155*a*, 155*b* as the shutter members move between the closed and open positions, and that is enough to move shutter 98 of waste toner outlet 95 from the closed position to the open position at which opening 99 of shutter 98 aligns with hole 97 of toner discharge pipe 96.

The above example embodiments have been described with respect to a removable waste toner container for image forming device 22. It will be appreciated, however, that the concepts and teachings described herein may also be used in other sub-systems of image forming device 22.

The foregoing description illustrates various aspects and examples of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A shutter assembly for sealing an inlet port, comprising:

a first shutter member and a second shutter member positioned about the inlet port, the first and second shutter members are each pivotable between an open position and a closed position about respective pivot axes that extend parallel to each other on opposite sides of the inlet port, when the first and second shutter members are in the closed positions respective free ends of the first and second shutter members seal against each other and respective first face portions of the first and second shutter members seal against a perimeter of the inlet port such that the first and second shutter members block the inlet port, when the first and second shutter members are in the open positions the first and second shutter members are pivoted away from each other and from the inlet port unblocking the inlet port, wherein the first and second shutter members are biased toward the closed positions.

2. The shutter assembly of claim 1, further comprising a first biasing mechanism coupled between the first shutter member and a wall surrounding the perimeter of the inlet port, and a second biasing mechanism coupled between the second shutter member and the wall surrounding the perimeter of the inlet port, the first and second biasing mechanisms respectively biasing the first and second shutter members toward the closed positions.

3. The shutter assembly of claim 2, wherein when the first and second shutter members are in the closed positions, the first and second biasing mechanisms each imparts a resultant force on the first and second shutter members, respectively, along a force vector that is angled relative to a first plane defined by the perimeter of the inlet port such that a direction of the force vector is toward the inlet port and a central portion of the shutter member, the force vectors of the resultant forces on the first and second shutter members when the first and second shutter members are in the closed positions both lie in a second plane that is orthogonal to the first plane and that is positioned at a midpoint of each shutter member along an axial dimension of the pivot axes such that the first and second shutter members provide a substantially uniform sealing pressure against each other and against the perimeter of the inlet port.

4. The shutter assembly of claim 2, wherein:

each of the first and second shutter members includes at least one arm extending from a second face portion thereof opposite the first face portion;

the first biasing mechanism includes a first spring coil connected between the at least one arm of the first shutter member and a first attachment point on the wall surrounding the perimeter of the inlet port, and a second spring coil connected between the at least one arm of the first shutter member and a second attachment point on the wall surrounding the perimeter of the inlet port, the first and second attachment points are located opposite to each other relative to the inlet port and the at least one arm of the first shutter member; and the second biasing mechanism includes a third spring coil connected between the at least one arm of the second shutter member and a third attachment point on the wall surrounding the perimeter of the inlet port, and a fourth spring coil connected between the at least one arm of the second shutter member and a fourth attachment point on the wall surrounding the perimeter of the inlet port, the third and fourth attachment points are located opposite to each other relative to the inlet port and the at least one arm of the second shutter member.

5. The shutter assembly of claim 4, wherein each of the first and second shutter members includes a trunion defining the pivot axis of the respective first or second shutter member, the first and second spring coils lie across the trunion of the first shutter member when the first shutter member is in the open position, and the third and fourth spring coils lie across the trunion of the second shutter member when the second shutter member is in the open position.

6. The shutter assembly of claim 4, wherein the first, second, third and fourth spring coils lie flat along a first plane defined by the perimeter of the inlet port when the first and second shutter members are in the open positions.

7. The shutter assembly of claim 4, wherein each of the first and second shutter members includes notches formed along peripheral edges of the second face portion opposite to each other relative to the at least one arm of said shutter member, the notches are shaped such that the first and second spring coils travel within respective notches of the first shutter member when the first shutter member moves between the closed position and the open position and the third and fourth spring coils travel within respective notches of the second shutter member when the second shutter member moves between the closed position and the open position.

8. The shutter assembly of claim 1, wherein each of the first and second shutter members includes a guide extending from a second face portion thereof opposite the first face portion along the free end such that when the first and second shutter members move from the open positions to the closed positions with one of the first and second shutter members reaching the closed position before the other of the first and second shutter members, the guides of the first and second shutter members slide against each other to facilitate movement of the other of the first and second shutter members toward the closed position.

9. A toner container, comprising:

a housing having a reservoir for holding toner;

an inlet port formed on the housing and in fluid communication with the reservoir for receiving toner; and a first shutter member and a second shutter member positioned about the inlet port, the first and second shutter members are each pivotable between a closed position and an open position, when the first and second shutter members are in the closed positions respective free ends of the first and second shutter members seal against each other and respective first face portions of the first and second shutter members seal against a perimeter of the inlet port such that the first and second shutter members block the inlet port, when the first and second shutter members are in the open positions the first and second shutter members are pivoted away from the inlet port unblocking the inlet port, wherein the first and second shutter members are biased toward the closed positions.

10. The toner container of claim 9, further comprising a biasing assembly positioned to bias the first and second shutter members toward the closed positions, wherein the biasing assembly imparts a resultant force on each of the first and second shutter members when the first and second shutter members are in the closed positions along a force vector that is angled relative to a first plane defined by the perimeter of the inlet port such that a direction of the force vector is toward the inlet port and a central portion of said shutter member.

11. The toner container of claim 10, wherein the force vectors of the resultant forces on the first and second shutter members when the first and second shutter members are in the closed positions both lie in a second plane that is orthogonal to the first plane and that is positioned at a midpoint of each shutter member along an axial dimension of respective pivot axes of the first and second shutter members such that the first and second shutter members provide a substantially uniform sealing pressure against each other and against the perimeter of the inlet port when the first and second shutter members are in the closed positions.

12. The toner container of claim 9, wherein each of the first and second shutter members includes at least one arm extending from a second face portion thereof opposite the first face portion, and the toner container further includes, for each of the first and second shutter members, at least one resilient member connected between the at least one arm and a portion of the housing surrounding the perimeter of the inlet port biasing said shutter member towards the closed position.

13. The toner container of claim 12, wherein the at least one resilient member of each of the first and second shutter members includes a compound tension spring having first and second spring coils connected in series, the compound tension spring is attached to the at least one arm of said shutter member at a location between the first and second spring coils and opposed ends of the compound tension spring are attached to the portion of the housing surrounding the perimeter of the inlet port opposite to each other relative to the inlet port and the at least one arm of said shutter member.

14. The toner container of claim 12, wherein the at least one resilient member of each of the first and second shutter members includes a first tension spring having a first end attached to the at least one arm of said shutter member and a second end attached to the portion of the housing surrounding the perimeter of the inlet port at a respective first attachment point, and a second tension spring having a first end attached to the at least one arm of said shutter member and a second end attached to the portion of the housing surrounding the perimeter of the inlet port at a respective second attachment point opposite the first attachment point relative to the at least one arm of said shutter member.

15. The toner container of claim 12, wherein each of the first and second shutter members includes a trunion defining a pivot axis of the respective first or second shutter member, and for each of the first and second shutter members, the at least one resilient member of said shutter member lies across the trunion when the shutter member is in the open position.

16. The toner container of claim 12, wherein for each of the first and second shutter members, the at least one resilient member of said shutter member lies flat along a first plane defined by the perimeter of the inlet port when the shutter member is in the open position.

17. The toner container of claim 12, wherein each of the first and second shutter members includes notches formed along peripheral edges of the second face portion opposite to each other relative to the at least one arm of said shutter member, the notches are shaped such that the at least one resilient member connected to the at least one arm of said shutter member travels within the notches when the shutter member moves between the closed position and the open position.

18. The toner container of claim 9, wherein each of the first and second shutter members includes a guide positioned along the free end thereof and extending inwardly into the reservoir such that when the first and second shutter members move from the open positions to the closed positions with one of the first and second shutter members reaching the closed position before the other of the first and second shutter members, the guides of the first and second shutter members slide against each other to facilitate movement of the other of the first and second shutter members toward the closed position.

19. A toner container, comprising:

a housing having a reservoir for holding toner;

an inlet port having an opening in fluid communication with the reservoir for receiving toner;

a first shutter member and a second shutter member positioned about the opening, the first and second shutter members are each pivotable between an open position and a closed position about respective pivot axes that extend parallel to each other on opposite sides of the opening, when the first and second shutter members are in the closed positions respective free ends of the first and second shutter members seal against each other and respective first face portions of the first and second shutter members seal against a perimeter of the opening such that the first and second shutter members each block a respective half of the opening, when the first and second shutter members are in the open positions the first and second shutter members are pivoted away from the opening unblocking the opening; and a biasing assembly that biases the first and second shutter members toward the closed positions, wherein the biasing assembly imparts a resultant force on each of the first and second shutter members when the first and second shutter members are in the closed positions along a force vector that is angled relative to a first plane defined by the opening such that a direction of the force vector is toward the opening and a central portion of said shutter member, the force vectors of the resultant forces on the first and second shutter members when the first and second shutter members are in the closed positions both lie in a second plane that is orthogonal to the first plane and that is positioned at a midpoint of each shutter member along an axial dimension of the pivot axes such that the first and second shutter members provide a substantially uniform sealing pressure against each other and against the perimeter of the opening when the first and second shutter members are in the closed positions.

20. The toner container of claim 19, wherein:

each of the first and second shutter members includes at least one arm extending from a second face portion thereof opposite the first face portion; and for each of the first and second shutter members, the biasing assembly includes a first spring coil connected between the at least one arm of said shutter member and a respective first attachment point on a portion of the housing surrounding the perimeter of the opening and a second spring coil connected between the at least one arm of said shutter member and a respective second attachment point on the portion of the housing surrounding the perimeter of the opening, the first and second attachment points are located opposite to each other relative to the opening and the at least one arm of said shutter member.

21. The toner container of claim 20, wherein each of the first and second shutter members includes a trunion defining the pivot axis of the respective first or second shutter member, and for each of the first and second shutter members, the first and second spring coils connected to said shutter member lie across the trunion when said shutter member is in the open position.

22. The toner container of claim 20, wherein for each of the first and second shutter members, the first and second spring coils connected to said shutter member lie flat along the first plane when said shutter member is in the open position.

23. The toner container of claim 20, wherein each of the first and second shutter members includes notches formed along peripheral edges of the second face portion opposite to each other relative to the at least one arm of said shutter member, the notches are shaped such that the first and second spring coils connected to the at least one arm of said shutter member travel within respective notches when the shutter member moves between the closed position and the open position.

24. The toner container of claim 19, wherein each of the first and second shutter members includes a guide positioned along the free end thereof and extending inwardly into the reservoir such that when the first and second shutter members move from the open positions to the closed positions with one of the first and second shutter members reaching the closed position before the other of the first and second shutter members, the guides of the first and second shutter members slide against each other to facilitate movement of the other of the first and second shutter members toward the closed position.

* * * * *